United States Patent [19]

Hackmann et al.

[11] Patent Number: 4,744,492

[45] Date of Patent: May 17, 1988

[54] DISPENSER FOR TABLETS, CAPSULES AND THE LIKE

[75] Inventors: Ludger Hackmann, Lohne; Peter Keller, Juchen, both of Fed. Rep. of Germany

[73] Assignee: Bramlage Gesellschaft mit beschrankter Haftung, Lohne/Oldenburg, Fed. Rep. of Germany

[21] Appl. No.: 926,915

[22] Filed: Nov. 3, 1986

[30] Foreign Application Priority Data

Nov. 2, 1985 [DE] Fed. Rep. of Germany ..... 3538923

[51] Int. Cl.[4] ..... B65D 83/04

[52] U.S. Cl. ..... 221/204; 221/299; 206/540

[58] Field of Search ..... 221/200, 201, 202, 204, 221/205, 206, 190, 268, 269, 271, 289, 299, 292; 222/243–246, 196, 199; 206/540; 366/108, 110

[56] References Cited

U.S. PATENT DOCUMENTS 4,230,236 10/1980 Boulter ..... 221/264 X

FOREIGN PATENT DOCUMENTS 628434 11/1961 Italy ..... 221/202

6406530 12/1964 Netherlands ..... 221/204

*Primary Examiner*—Joseph J. Rolla

*Assistant Examiner*—Lisa C. Wang

*Attorney, Agent, or Firm*—Collard, Roe & Galgano

[57] ABSTRACT

There is provided a dispenser with a casing for tablets, capsules and the like, with a drop-out opening closed by a slide for dispensing one tablet at a time, the opening being disposed at the end of a tablet feed duct designed to hold a plurality of tablets in a prearranged position. A shaking/vibrating motion is imparted to the tablet feed duct during dispensing of a tablet so as to prevent bridging of the tablets and blocking of the dispensing passageway.

9 Claims, 6 Drawing Sheets

FIG. 4
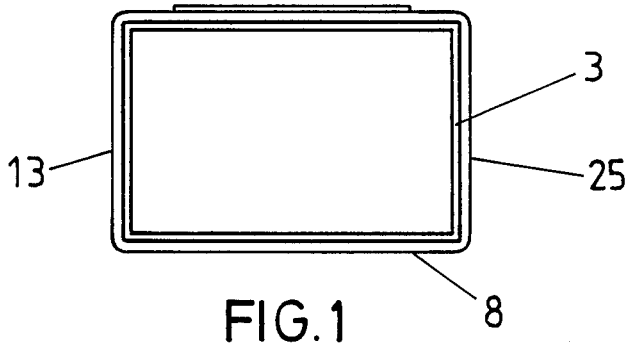
FIG. 1
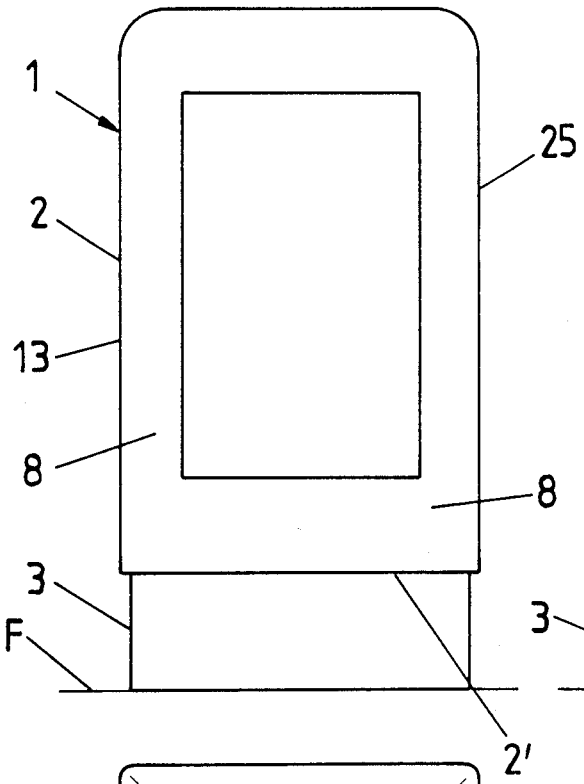
FIG. 2
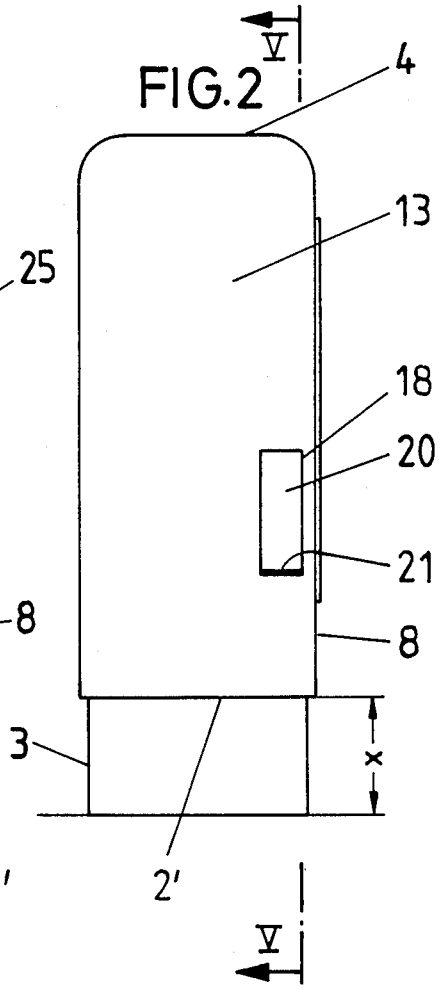
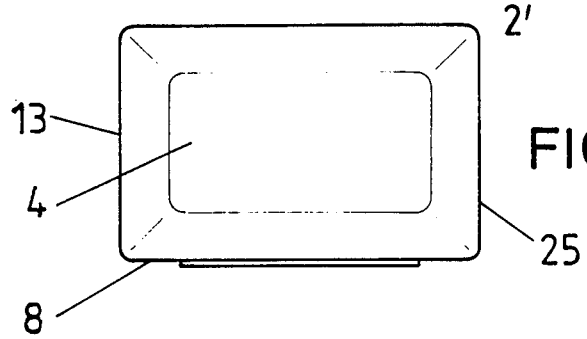
FIG. 3

DISPENSER FOR TABLETS, CAPSULES AND THE LIKE

The present invention relates to a dispenser having a casing for tablets, capsules and the like, with a drop-out opening closed by a slide for dispensing one tablet at a time, the opening being disposed at the end of a tablet free duct designed to hold a plurality of tablets in a prearranged position.

In prior art dispensers, despite the proper positioning of that portion of the tablet supply that is directly ready for dispensing, dispensing problems caused by bridging of the tablets thereby blocking the discharge passageway occur time and again in the final approaches to the discharge opening. It has been proposed to lower the leading layer on a moving ramp into the discharge zone while fingers are driven between the individual tablets like a rake, which is expected to loosen up the supply that is ready for dispensing. However, even such measures do not lead to optimal functioning mainly because of the shape of the tablets. Frequently, one tries to correct such problems by shaking the entire dispenser, which, however, does not eliminate the problem if the material is jammed, but rather might destroy the tablets or the skin of the capsules.

The object of the present invention is to provide a dispenser of the type described above which has a simple design with respect to its function of individualizing the contents for dispensing while operating trouble-free even with tablet forms that deviate from the usual shape, such as tablets in the form of spheres, round platelets, etc.

The above object is accomplished in accordance with the present invention wherein practically no dispensing problems result because bridge-like formations of the material to be dispensed, which might inhibit proper individualizing of the contents, is eliminated as a result of the normal actuation of the dispenser which is provided with means for shaking/vibrating the tablet feed duct upon actuation of the dispensing slide. Any bridging of the dispenser contents is prevented as a result of the shaking/vibrating motion of the tablet feed duct. This means that there is no need for shaking the entire dispenser as is usually done with conventional designs, frequently leading to breakage mainly of weakly bonded tablets and to incorrect dosing as fragments of a destroyed tablet or the like are dispensed. Even problematic lentil-shaped tablets no longer assume any jamming, clapboard-like positioning. The vibration of the tablet feed duct takes place in the plane of the side wall of the duct. The prearranged tablets, capsules and the like practically repel each other while their advance in the discharge direction is effected. The tablet advance is also effected by the load of the supply in the casing of the dispenser, which falls into place in the duct. The component acting in the direction of discharge exists even if the course of the feed duct slopes downwardly only slightly.

The shaking/vibrating motion can be accomplished simply by mounting the tablet feed duct on a wall of the interior part of the casing which is flexibly connected at one end. The cap-shaped outer part of the casing having the discharge or drop-out opening is displaceable relative to the interior part of the casing and has a toothed strip whose teeth move across the free end of a finger protruding from the wall forming the tablet feed duct in the manner of a ratchet thereby producing a high degree of vibration of the feed duct. The wall is disposed laterally adjacent to and beneath the bottom of the casing in a constructively simple way. In this way, the leading tablet layer that is directly ready for dispensing is not loaded by the entire tablet supply. It is useful, mainly for the dosed dispensing of capsules, if the tablet feed duct in the wall has an "S" shape with the center segment of the "S" dimensioned slightly smaller than twice the dimension of the tablets or twice the diameter of the capsules. In this way, sufficient free space remains on the top side without permitting the next-following capsule to fill such space.

The shaking/vibrating motion can be intensified mainly in the free end zone of the duct by extending the bottom wall of the tablet feed duct in the form of a freely projecting, whip-shaped tongue. Furthermore, an advantageous embodiment is achieved by a forced slot-and-pin control for producing the shaking/vibrating motion of the tablet feed duct. Such design does not require any additional components but only some design adjustments, that is, shaping the parts that are movable relative to each other and forming the casing in a particular way. To accomplish this, it was found to be advantageous if the wall supporting the tablet feed duct is linked with the interior part of the casing by means of a joint and spring-mounted by means of a leaf spring, with support of the spring force within the zone of the slot-and-pin guide. Finally, the invention proposes that with its free end, the toothed strip forms a dividing finger for holding back in each case the next to last tablet. In this way, the strip is provided with a double function.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 1 is a front elevational view of a dispenser according to the present invention;

FIG. 2 is a side elevational view of the dispenser of FIG. 1;

FIG. 3 is a top plan view of the dispenser of FIG. 1;

FIG. 4 is a bottom plan view of the dispenser of FIG. 1;

Now turning to the drawings, therein is shown a dispenser for the individual dispensing of similarly shaped objects having a box-shaped casing 1 consisting of a cap-shaped outer casing part 2 and an interior casing part 3, which parts can be displaced relative to each other with limitation by means of stops. Interior part 3 of the casing of the dispenser, which is designed as a table model, is inserted in cap-shaped outer part 2 of the casing from the bottom, taking into account a spacing "x" between setup surface "F" and face edge 2' of the cap which conforms to at least the actuating stroke of a dispensing mechanism "M". For the actuation of the dispenser, it is necessary, as clearly seen in FIG. 5, to apply to ceiling 4 of cap-shaped outer part 2 of the casing a force "P" in the direction of the arrow.

Figure 6:
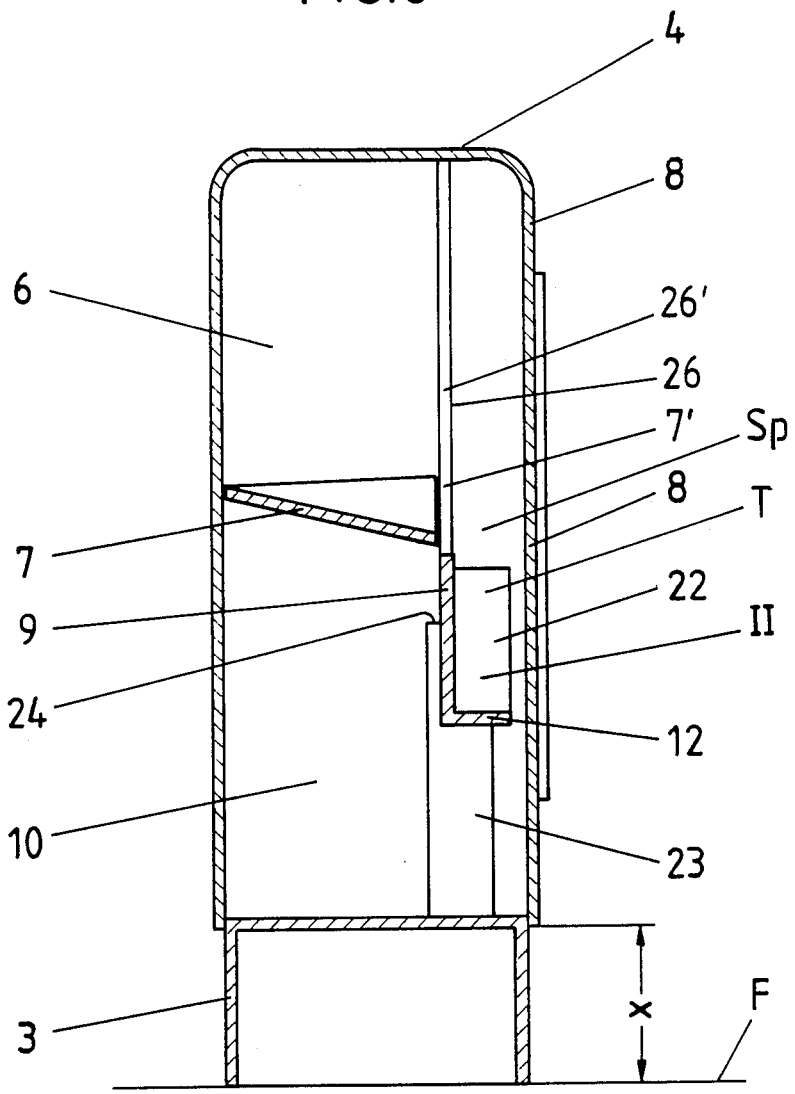
FIG. 6 is a cross-sectional view of the dispenser taken along line VI—VI of FIG. 5.

The objects to be dispensed, which are in the form of capsules 5, are located in a supply space 6 formed in the upper zone of outer part 2 of the casing. This supply space 6 is limited by a casing bottom 7 which extends with a downward slope in the direction of a wide side wall 8 of casing 1, as clearly seen in FIGS. 6 and 8. This "slide" or casing bottom 7 ends with a spacing from wide side wall 8, so that the filling material can advance into the zone or range of the dispensing mechanism "M" by way of the gap "Sp". A tablet feed duct "K" starts at the lowest point of casing bottom 7. This feed duct is disposed on a wall 9 of interior part 3 of the casing, which wall is flexibly connected at one end and extends parallel with wall 8. This connection is formed in the end zone on the discharge side at the left beneath tablet feed duct "K", whereas the remaining section of the tablet feed duct "K", which extends from that point with an upward slope to the right, freely projects into lower space 10 of casing 1, this space accommodating the dispensing mechanism.

Tablet feed duct "K" has a U-shaped cross section over a major part of its length, with the opening of the "U" pointing in the direction of wide side wall 8, the latter forming the fourth wall of the duct, which is displaceable relative to tablet feed duct "K". Wall 9 forming the bridge of the U-profile has basically the shape of an "S", whereby only the center section of the "S" has a slightly smaller dimension than twice the dimension of the tablet or twice the diameter of capsules 5 shown in the drawing. End II of the duct on the discharge side and head I of the duct, which is disposed on the other side of the center section, deviate from this measure, that is, they change into a larger width, which, relative to head I of the duct, changes into a funnel "T" which widens in the upward direction, that is, in the direction of supply space 6. Leg 11 of the "U" follows a diverging course relative to the other leg 12 of the "U", which forms a downwardly sloped slide or ramp, and, furthermore, is displaced relative to the latter in its position in the vertical sense, i.e., leg 11 is disposed higher than leg 12 of the "U".

Figure 5:
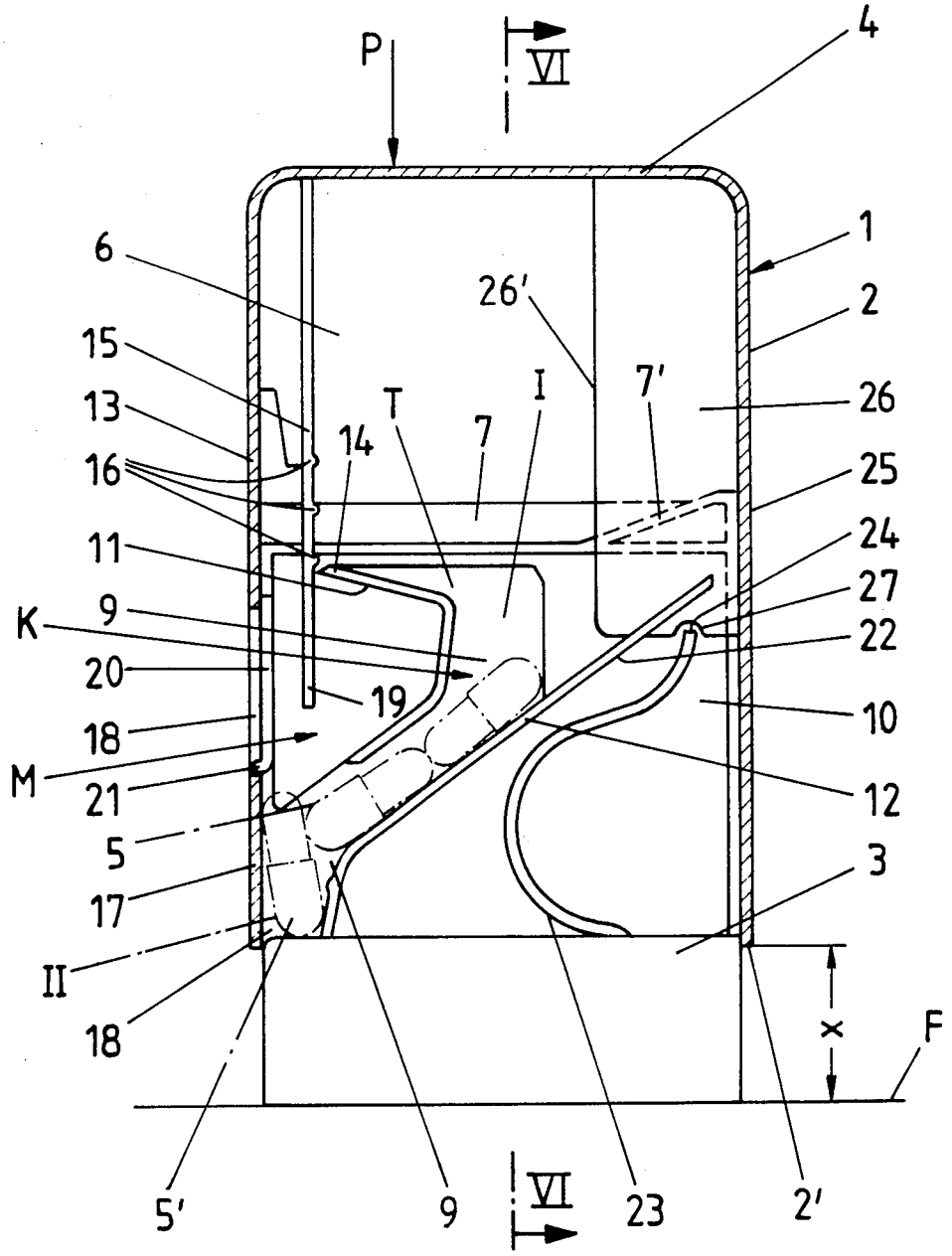
FIG. 5 is a cross-sectional view of the dispenser taken along line V—V of FIG. 2.

Leg 11 of the "U" ends in the form of a finger or protrusion 14, which extends slightly ascending in the direction of narrow wall 13 of outer part 2 of the casing. This finger 14 cooperates with a downwardly extending toothed strip 15, which is seated on the vertically displaceable outer part 2 of the casing, as seen in FIG. 5. On actuation, teeth 16 of strip 15, which are disposed transversely to vertical displacement and rounded crosswise, move across the free end of finger 14 of wall 9 forming the tablet feed duct "K", such motion being performed in the manner of a ratchet. The plane of vibration lies in the plane of vertical side wall 9 of tablet feed duct "K". The outer part 2 of the casing forms a slide 17 which controls the dispensing operation, which slide closes the end II of the duct with a section of its wall when it is in its basic position. The initial capsule 5' of the arranged layer of capsules, such capsule being ready for dispensing, can drop out only after the drop-out or discharge opening 18 of the cap-shaped outer part 2 of the casing has been shifted into the zone of the duct end II forming a dispensing chamber, such opening 18 being disposed next to the closing section of the wall of the slide 17. In order to hold back the rest of the leading layer and to loosen up the latter further, toothed strip 15 extends beneath the zone or section supporting teeth 16, thus at its free lower end, changing into a dividing finger 19. Before capsule 5', which is directly ready for dispensing, is released for dispensing by slide 17, dividing finger 19 has already been positioned in front of the dome headed end of the next-following capsule, so that the latter is held back while being slightly displaced in the backward direction.

Figure 7:
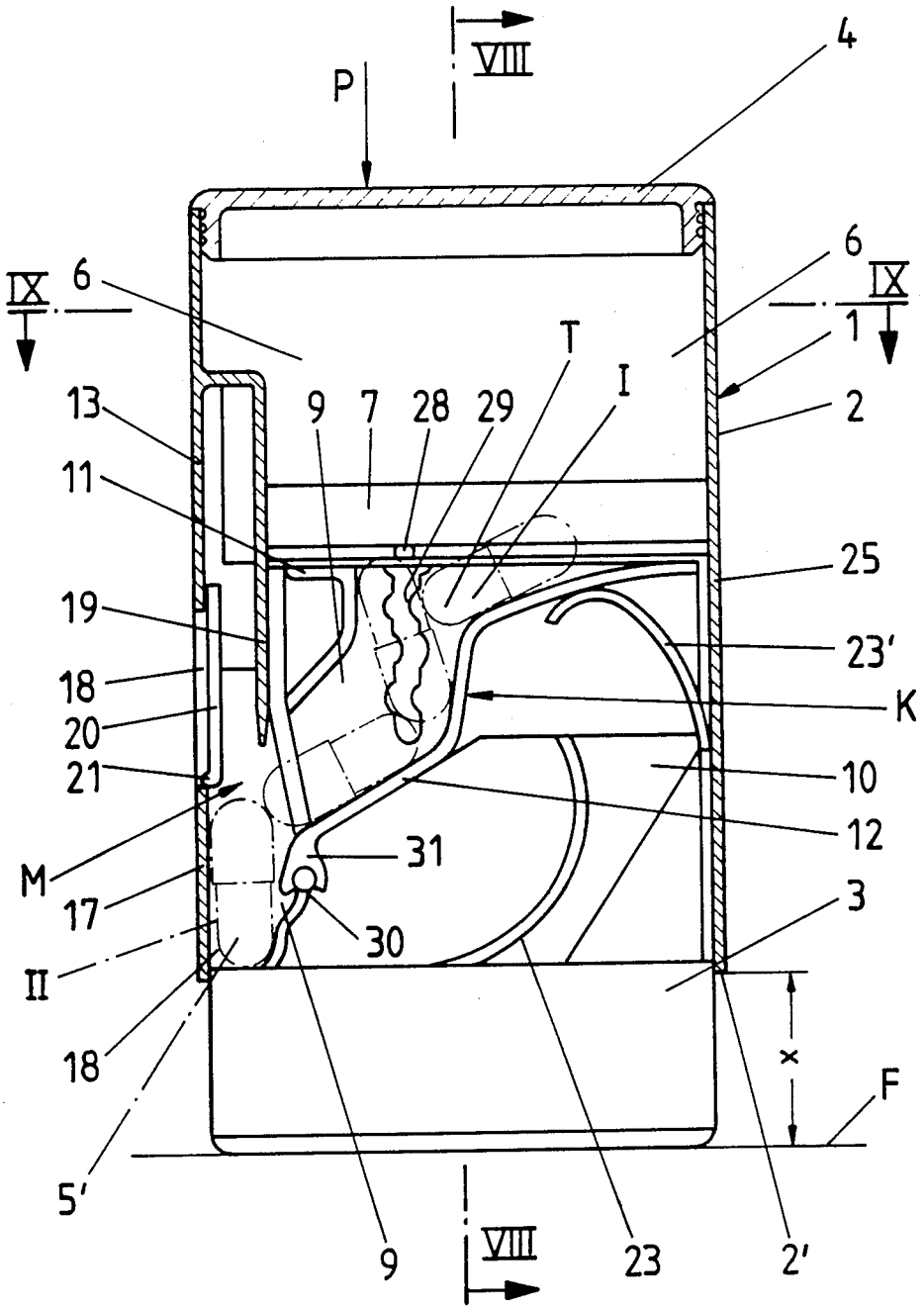
FIG. 7 is a cross-sectional view similar to that of FIG. 5 of another embodiment of the dispenser according to the present invention.

In the basic closing position shown in FIGS. 5 and 7, the closing of the slide/drop-out opening 18 is effected by a vertical wall section 20 of interior casing part 3, which basically has the shape of a frame. The lower end of this wall section projects into window-shaped drop-out opening 18 with a stop finger 21. This finger 21 assures that the two-component dispenser unit is kept together and also defines the exact actuation stroke in that it either assumes a blocking position ahead of the lower edge of the window of discharge opening 18, or shifts against the corresponding horizontal window edge of opening 18 at the top. Of course, the limitation in this respect can be formed also by face edge 2' of outer part 2 of the casing, which edge faces in the direction of the supporting surface "F".

A shaking/vibration motion of tablet feed duct "K" is produced as toothed strip 15 moves across the free end of finger 14 in the manner of a ratchet. This motion loosens up both the leading layer and the tablets or capsules 5 disposed directly in front of funnel "T", preventing the bridging of the objects to be dispensed over funnel "T". Bridges that would prevent filling of duct "K" will collapse with the vibration, and the tablets aligned singly in a perfect manner. The whip-like, freely projecting tongue 22 extending the slide with full utilization of the free space available in this direction, which tongue extends from the bottom wall of tablet feed duct "K" formed by leg 12 of the "U", has an effect that further promotes the shaking/vibrating motion. The corresponding vertical cutout of wall 9 is disposed approximately in the center zone of funnel "T", where the width of vibration of the tongue 22 is still large enough even if the shaking or vibrating motion of the part of the duct with wall 9 has already noticeably faded. Even overlapping vibration of both parts is produced.

The basic closed position of the dispenser (as shown in the drawings) is maintained by the biasing action of a spring. The spring used is a leaf spring 23 rooted in the lower base-like horizontal leg of the frame-shaped interior part 3 of the casing. At its upper end 24, leaf spring 23 acts on a rib 26 extending from narrow wall 25 on the right side of outer part 2 of the casing. The bottom side of rib 26 has a recess 27 designed to accommodate end 24 of spring 23. The rib, which is connected with the ceiling of the cap-shaped outer part as well, projects into the zone or range of the tablet feed duct to an extent such that no objects can be between the recessed zone and corresponding face surface 26', yet the free space required for the oscillating motion is available. So as not to neutralize the zone of supply space 6 behind the rib 26 with respect to filling of the funnel, this zone is designed in a way such that with a downward slope in the direction of funnel "T", that is, in the direction of the narrow wall 13 having the discharge or drop-out opening 18. This sloped section is denoted by reference numeral 7' and a component of the bottom 7 of the casing. As a result of rib 26, tongue 22 is also kept free from the load of the supply, so that it can freely vibrate.

Figure 8:
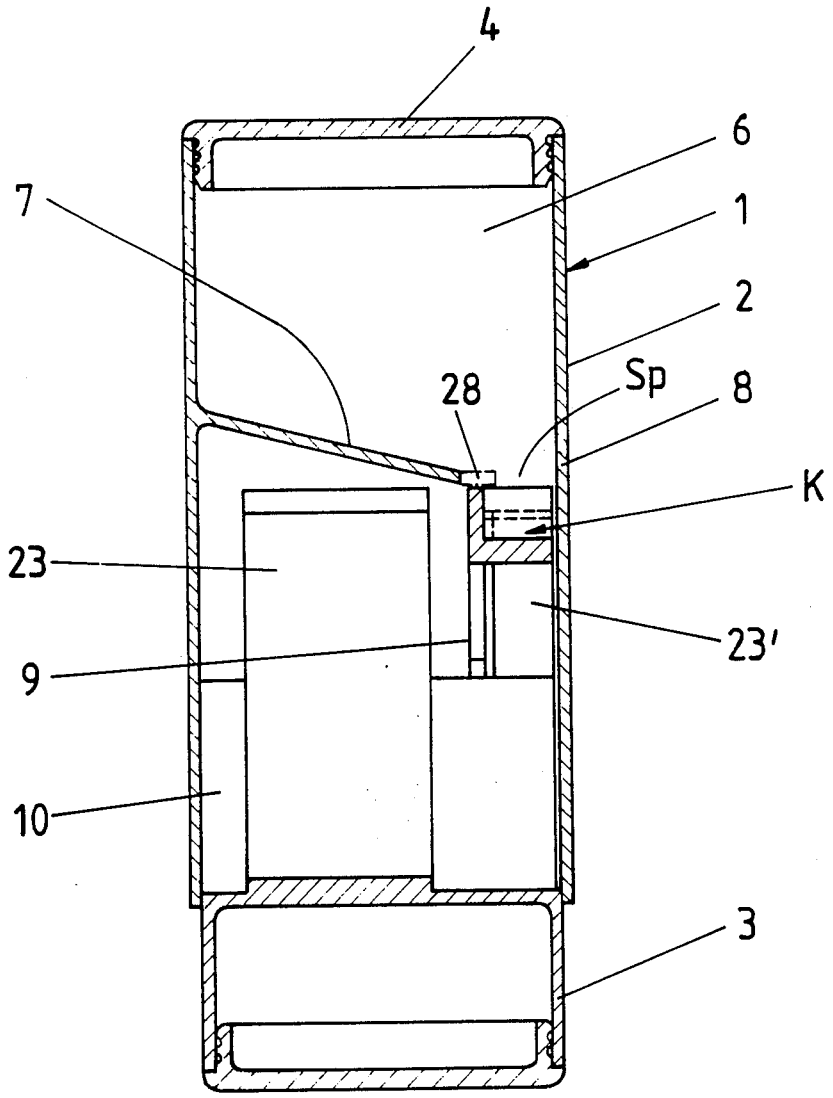
FIG. 8 is a cross-sectional view of the dispenser of FIG. 7 taken along line VIII—VIII of FIG. 7.
Figure 9:
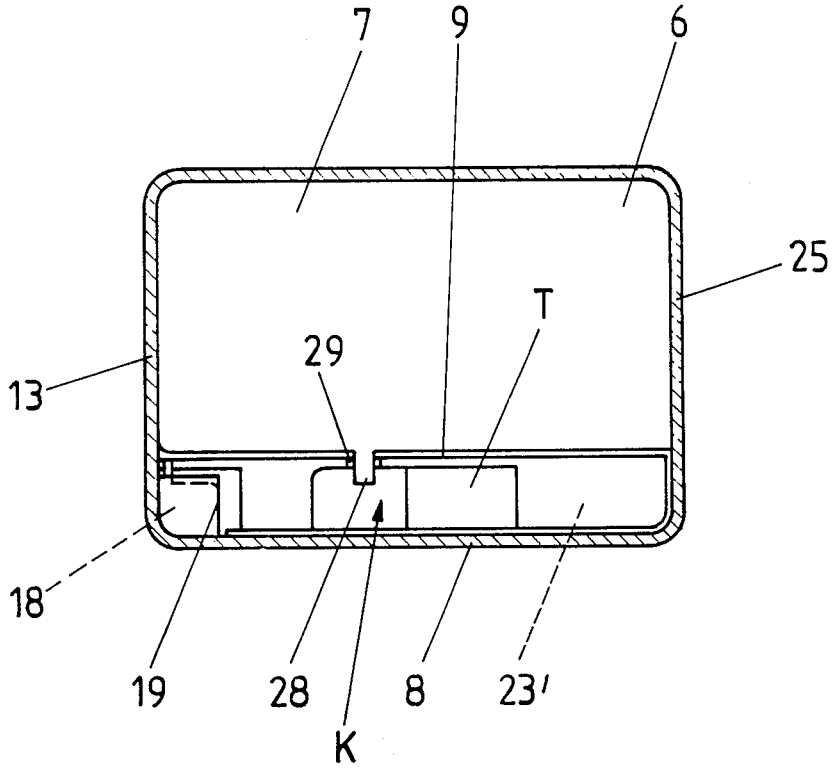
FIG. 9 is a cross-sectional view of the dispenser of FIG. 7 taken along line IX—IX in FIG. 7.

The embodiment according to FIGS. 7 to 9 has basically the same structural design as described above in connection with FIGS. 1 to 6. Identical components are denoted by the same reference numerals without repeating in the following the description to some extent. The difference between the embodiment described in the foregoing and the one explained in the following is that in the latter case, forced control is used for producing the shaking/vibrating motion of tablet feed duct "K". This is accomplished by exploitation of the relative motion between the outer and inner parts of the casing and is based on a link or coulisse control. The control pin of this coulisse control is denoted by reference numeral 28. This pin extends from the lower edge of bottom 7 that faces wide wall 8, the pin being of such a length that it crosses the plane of swivel of the tablet feed duct, that is, it crosses wall 9 which jointly forms the feed duct and also forms the associated slot 29 of the coulisse. Its effective length takes into account the basic vertical lift of outer part 2 of the casing. FIG. 7 clearly shows the zigzag-shaped configuration, which represents slot deviations laterally of the vertical direction of motion with recesses equally extending on both sides of the symmetrical plane. However, instead of having a connection as with the first embodiment, which connection can be produced by injection molding in the present case as well, the present design incorporates a deviating association in that wall 9 forming tablet feed duct "K" is linked with the interior part 3 of the casing by means of a joint 30. In addition to a leaf spring 23, which is associated in a similar manner in the present case or embodiment and acts directly on the bottom side of casing bottom 7 in this case also, the free end part of wall 9 forming the duct, which end part points in the direction of narrow side wall 25, is spring-mounted with the help of a leaf spring 31 as well, with support of the spring force within the zone of the slot-and-pin guide 28, 29. So as to facilitate assembly, inner part 3 of the casing forms a journal pin on an arm extending from a bridge forming the base, such journal pin being engaged by a fork-shaped, open bearing eye 31 of wall 9. The opening of bearing eye 31 takes into account a smoothly operating snap-arrest association crosswise relative to the horizontal extension of the axis. Joint 30 is disposed at the level of half the height of the duct end II, again within the proximity of dividing finger 19, which is driven vertically at the bottom left and whose free end is tapered in both embodiments.

Furthermore, the second embodiment shows ceiling 4 designed in the form of a detachable closure cap. This means that the dispenser can be refilled without pulling out frame-like interior part 3 of the casing.

For the purpose of closing the base, which is left open at the bottom with the first embodiment of the invention, it is necessary only to place a cap over the base as it has been realized with the second embodiment. In this way, a second actuating surface is obtained in case the dispenser is to be realized as a pocket unit. For this purpose, using both ends of the casing, the dispenser only needs to be pushed together, pushing one part into the other, with the discharge opening facing in the downward direction.

While two embodiments of the present invention have been shown and described, it will be obvious that many changes and modifications may be made thereunto without departing from the spirit and scope of the invention.

What is claimed is:

1. A dispenser for tablets, capsules and the like, comprising:

(a) a casing for containing said tablets;

(b) a slide associated with said casing;

(c) a drop out opening in said casing closable by said slide;

(d) a tablet feed duct having a substantially U-shaped cross section, said duct being movable relative to the casing and the slide, said slide upon displacement cooperating with said duct; and (e) cooperating matching moldings on said slide and said tablet feed duct which deflect the tablet feed duct from the direction of movement of the slide so as to produce a shaking or vibrating motion of the tablet feed duct as a result of the slide operation.

2. The dispenser according to claim 1, wherein the tablet feed duct vibrates in the plane of its side wall.

3. The dispenser according to claim 1 wherein said means comprises a forced slot-and-pin control for producing the shaking/vibrating motion of the tablet feed duct.

4. The dispenser according to claim 3, which further comprises a wall connected with an interior part of the casing via a joint, said wall supporting said tablet feed duct and being spring-mounted by means of a leaf spring with support of the spring force within the zone of the slot-and-pin guide.

5. A dispenser for tablets, capsules and the like, comprising:

(a) a casing for containing said tablets having an interior part and a cap-shaped outer part displaceable relative thereto;

(b) a drop out opening in the outer part of said casing for dispensing a single tablet at a time;

(c) a slide associated with the outer part of said casing for closing said drop out opening;

(d) a tablet feed duct in said casing at the end of which is disposed said drop out opening, said duct being adapted to receive a plurality of tablets in a prearranged position;

(e) a wall on the interior part of said casing flexibly connected at one end and on which is disposed said tablet feed duct;

(f) a toothed strip arranged on the outer part of said casing, the teeth of said strip engaging ratchet-like across the free end of a finger projecting from the wall on which said tablet feed duct is disposed, so that a shaking or vibrating motion of the tablet feed duct results from the actuation of said slide.

6. The dispenser according to claim 5, wherein the wall on which said tablet feed duct is disposed is laterally adjacent to and beneath a bottom wall of the casing.

7. The dispenser according to claim 5, wherein said toothed strip has a free end which forms a dividing finger holding back in each case the next to last tablet to be dispensed.

8. The dispenser according to claim 5, wherein the tablet feed duct has an "S" shape whose center section is dimensioned slightly smaller than twice the dimension of the tablet.

9. The dispenser according to claim 8, wherein said feed duct, in addition to the wall on which it is disposed, has two delimiting side walls so that said feed duct has a "U" shaped cross section, the lower side wall of which extends as a freely projecting, whip-shaped tongue.

* * * * *